United States Patent [19]

Tsuruoka et al.

[11] Patent Number: 4,714,427

[45] Date of Patent: Dec. 22, 1987

[54] FIXING DEVICE FOR COPYING MACHINE

[75] Inventors: Ichiro Tsuruoka, Tokyo; Mitsuru Takahashi, Miyagi, both of Japan

[73] Assignee: Ricoh Company, Ltd., Tokyo, Japan

[21] Appl. No.: 36,128

[22] Filed: Apr. 6, 1987

Related U.S. Application Data

[63] Continuation of Ser. No. 817,824, Jan. 10, 1986, abandoned.

[30] Foreign Application Priority Data

Apr. 26, 1985 [JP] Japan ..... 60-088877

[51] Int. Cl.[4] ..... F27B 9/28; H05B 1/00; F26B 3/18

[52] U.S. Cl. ..... 432/59; 432/60; 219/216; 34/95

[58] Field of Search ..... 432/59, 60, 8; 219/216, 219/469; 34/95

[56] References Cited

U.S. PATENT DOCUMENTS

| | | | |
|---|---|---|---|
| 3,857,189 | 12/1974 | Katayama et al. | 219/216 |
| 4,163,892 | 8/1979 | Komatsu et al. | 219/469 |
| 4,253,008 | 2/1981 | Dolan | 432/60 |
| 4,348,102 | 9/1982 | Sessink | 432/60 |
| 4,384,783 | 5/1983 | Sakata et al. | 432/60 |
| 4,408,559 | 10/1983 | Sugiura | 432/60 |

*Primary Examiner*—Henry C. Yuen

*Attorney, Agent, or Firm*—Cooper, Dunham, Griffin & Moran

[57] ABSTRACT

One or two auxiliary rollers of relatively small diameter are pressed against the peripheral surface of a main rotatable body which is heated. Where the two auxiliary rollers are employed, they are spaced apart from each other and are rotated in one direction at the same peripheral speed as that of the main rotatable body. A sheet carrying an unfixed toner image is fed by being gripped between the main rotatable body and the auxiliary rollers, during which the toner is heated and dried, and fixed to the sheet with the solvent evaporated. Thereafter, the sheet is discharged toward a next process. The sheet auxiliary sheets are relatively disposed under certain positional conditions for keeping the sheet in intimate contact with the main rotatable body to achieve proper toner fixing and sheet feeding operations.

6 Claims, 12 Drawing Figures

FIXING DEVICE FOR COPYING MACHINE

This is a continuation of application Ser. No. 817,824, filed Jan. 10, 1986, abandoned.

BACKGROUND OF THE INVENTION

The present invention relates to a fixing device for fixing a toner image to a sheet of paper in a copying machine.

There are known toner image fixing devices for use in copying machines, wherein two feed rollers are pressed against a heating roller for being simultaneously rotated thereby. A sheet of transfer paper carrying an unfixed toner image is fed along by being gripped between the heating roller and the feed rollers with the result that the toner image can be fixed to the sheet by being heated and dried. As the distance between the feed rollers becomes larger, the area of the sheet which is held in contact with the heating roller is greater so that the heating efficiency will be increased for drying and fixing the toner image more effectively.

If the feed rollers were spaced apart excessively, however, the sheet would tend to peel off the heating roller upwardly between the feed rollers and hence would fail to be gripped between the downstream feed roller and the heating roller, resulting in a paper jam.

SUMMARY OF THE INVENTION

In view of the aforesaid problem of the conventional fixing devices, it is an object of the present invention to provide a toner image fixing device capable of reliably feeding a sheet of transfer paper with a toner image carried thereon and of assuring an increased area of contact of the sheet with a main rotatable body or roller.

According to the present invention, auxiliary rollers are disposed with respect to each other and a main rotatable body or roller under certain positional conditions for feeding a sheet of transfer paper effectively without a jam and for heating the sheet efficiently.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
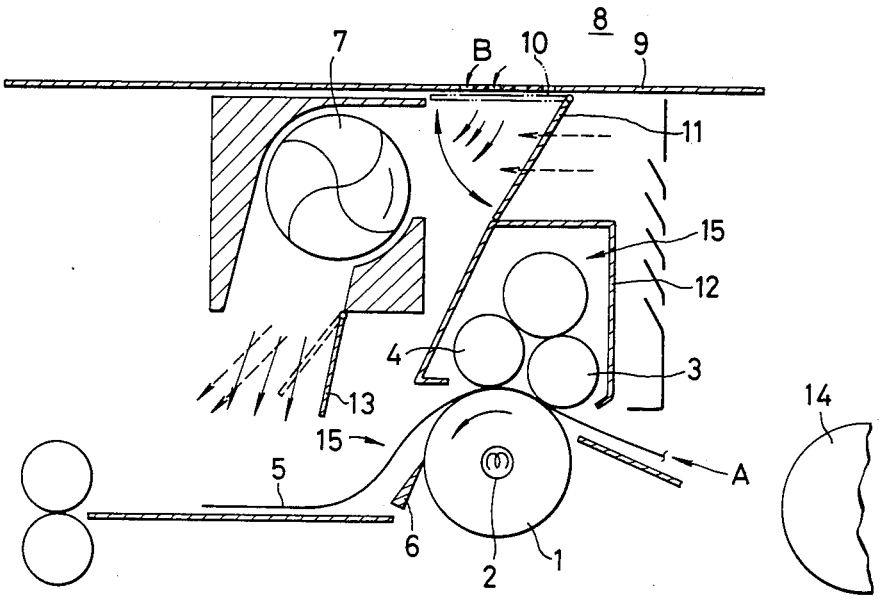
FIG. 1 is a schematic front elevational view of a fixing device according to an embodiment of the present invention, wherein a main rotatable body comprises a heating roller.

FIG. 1 schematically shows a toner image fixing device according to the present invention. The toner image fixing device incorporated in a wet-type electro-photo-graphic copying machine includes a main rotatable body or roller 1 serving as a heating roller having a heating means 2 such as a heater therein. Two auxiliary rollers or feed rollers 3, 4 are disposed in rolling contact with an upper portion of the main roller 1. Therefore, when the main roller 1 is rotated by a drive means (not shown), the auxiliary rollers 3, 4 are caused thereby to rotate about their own axes.

When a sheet 5 of transfer paper carrying an unfixed toner image thereon is delivered in the direction of the arrow A, it is gripped first between the main roller 1 and the feed roller 3 and then between the main roller 1 and the feed roller 4. During this time, the toner image is heated and dried by the heating means 2, and fixed to the sheet 5 with the solvent evaporated. Thereafter, the sheet 5 is peeled off the main roller 1 by a sheet separator 6 and discharged through a sheet outlet into a discharge tray (not shown). The sheet separator 6 is held against the peripheral surface of the main roller 1 and positioned downstream of the auxiliary rollers 3, 4 in the direction in which the main roller 1 rotates.

Where the auxiliary rollers 3, 4 are spaced apart a larger distance, the area of the sheet 5 held in contact with the main roller 1 becomes greater. Therefore, the heating efficiency is increased since more heat is applied by the heating means 2 to the sheet 5. If the distance between the auxiliary rollers 3, 4 were too large, however, the sheet 5 would peel off the main roller 1 and go over the feed roller 4, resulting in a paper jam, as described above.

Figure 2:
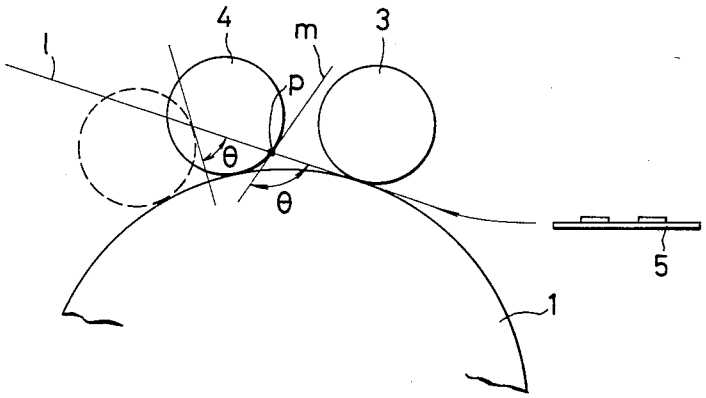
FIG. 2 is an enlarged fragmentary front elevational view of the fixing device shown in FIG. 1, with two auxiliary rollers of equal diameter.

As shown in FIG. 2, the main roller 1 and the auxiliary roller 3 which is located upstream of the auxiliary roller 4 in the direction of feed of the sheet 5 have a common tangential line 1, and this tangential line passes through a point P on the peripheral surface of the downstream feed roller 4. A line m tangential to the peripheral surface of the feed roller 4 at the point P has a downward section which forms an angle $\theta$ with the common tangential line 1. According to the present invention, this angle $\theta$ is selected to be in the range of:

$$90^\circ \leqq \theta < 180^\circ$$

In other words, the angle $\theta$ is selected as an obtuse angle.

With this arrangement, when the sheet 5 is fed substantially along the common tangential line l by being gripped between the main roller 1 and the auxiliary roller 3, the leading end of the sheet 5 engages the auxiliary roller 4 while it is directed toward the center of the auxiliary roller 4 if the angle $\theta$ is 90°. Since the auxiliary roller 4 is rotated clockwise about its own axis, the leading end of the sheet 5 is directed downwardly rather than upwardly and can reliably be gripped between the main roller 1 and the auxiliary roller 4.

If the angle $\theta$ were an acute angle as indicated by the dotted line in FIG. 2, the leading end of the sheet 5 would hit an upper portion of the auxiliary roller 4 with the result that a paper jam would be highly likely to occur. The following table shows the relationship between the angle $\theta$ and the sheet jam occurrence:

| $\theta$ | Sheet jam occurrence |
|---|---|
| Tangent line l does not intersect auxiliary roller 4 | 100% jam |
| $0 < \theta < 90°$ | Possible jam |
| $90° \leqq \theta \leqq 180°$ | No jam |

Therefore, if the angle $\theta$ is an obtuse angle, the sheet 5 can be fed along the main roller 1 without fail. For a better heating efficiency, it is advantageous for the angle $\theta$ to be selected to be an obtuse angle close to 90°, preferably in the range of from 120° to 90°, for example.

Figure 3:
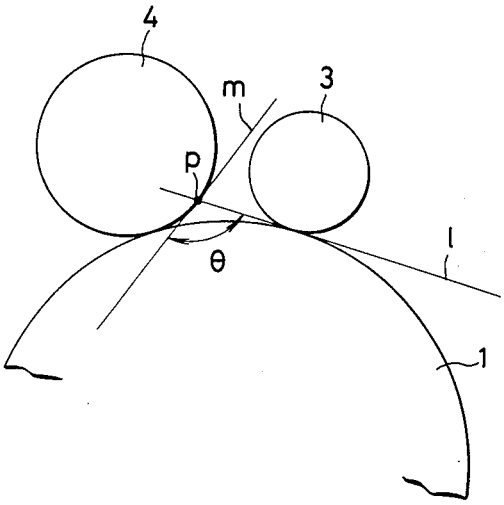
FIG. 3 is an enlarged fragmentary front elevational view of another fixing device with a downstream auxiliary roller larger in diameter than an upstream auxiliary roller.

The sheet feeding effectiveness and the heating efficiency can be improved by the aforesaid arrangement. The heating efficiency can be increased to a greater extent by increasing the diameter of the downstream auxiliary roller 4 as shown in FIG. 3. The heating efficiency could be improved by increasing the diameter of the main roller 1, but the required installation space and the cost would be increased. The scheme of FIG. 3 allows the angle $\theta$ to remain an obtuse angle even if the distance between the auxiliary rollers 3, 4 is larger than that shown in FIG. 2.

The fixing device shown in FIG. 1 will be described in greater detail.

A fixing assembly 15 includes a fan 7 for applying hot air against the sheet 5 to accelerate the drying of the toner image thereon so that the toner image can be fixed with increased efficiency. The fan 7 also serves to cool a sheet of contact glass and an optical system 8.

Between the optical system 8 and the fixing assembly 15, there is disposed a partition 9 having an opening 10 selectably closable by a changeover plate 11 pivotally mounted on the partition 9. The changeover plate 11 is angularly movable by a drive means (not shown) between a two-dot-and-dash-line position in which it closes the opening 10 and a solid-line position in which it is held against an upper cover 12 of the fixing device. The direction of air from the fan 7 can be changed by an air deflector 13.

During one copying cycle, i.e., from the time a copying start signal is given until the sheet 5 is discharged out of the copying machine, the changeover plate 11 is held in the solid-line position. Air is drawn by the fan 7 from an air inlet (not shown) into the optical system 8 to cool the same. The air as heated by the optical system 8 is introduced by the fan 7 in the direction of the arrow B into the fixing assembly 15 and applied to the sheet 5 to accelerate the fixing of the toner image to the sheet 5. While the copying machine is not in a copying cycle or is in a standby condition, the changeover plate 11 is angularly moved to the two-dot-and-dash-line position for permitting the fan 7 to draw air from around a photo-sensitive drum 14 so that no heat will be applied by the fixing device to the photosensitive drum 14. At this time, the air deflector 13 is shifted to the dotted-line position to direct the air from the fan 7 toward the sheet outlet so that the air will be discharged out of the copying machine instead of reaching the photosensitive drum 14.

If the optical system 8 is cooled by some other means during copying operation, the changeover plate 11 may be turned at an early stage from the solid-line position to the two-dot-and-dash-line position, or conversely may be turned from the solid-line position to the two-dot-and-dash-line position after the sheet 5 has been discharged.

Figure 4:
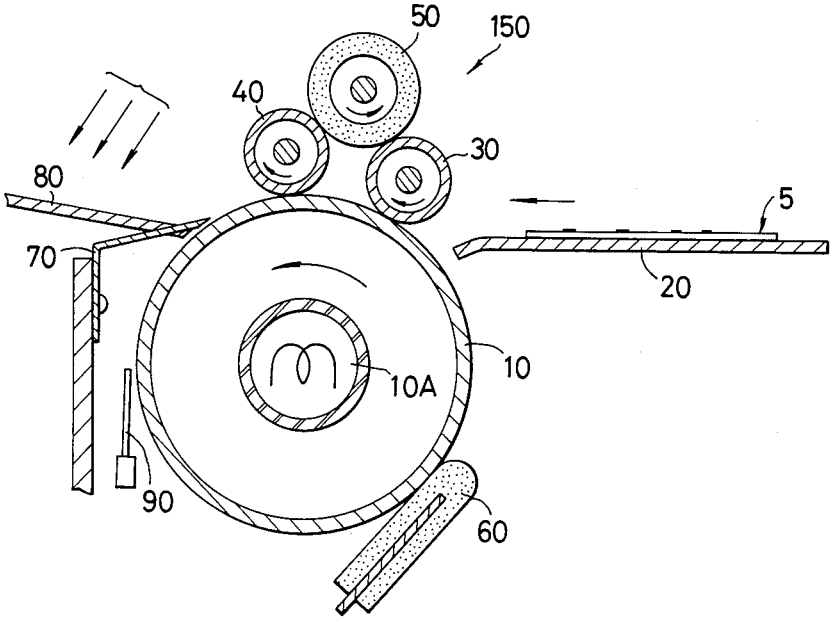
FIG. 4 is a sectional front elevational view showing a fixing device of the invention in greater detail.

FIG. 4 shows a fixing device of the present invention in greater detail, in which a main rotatable body or roller is disposed in opposite relation to auxiliary rollers.

As illustrated in FIG. 4, a feed plate 20 is disposed at the inlet of a fixing assembly 150 for feeding and guiding a sheet 5 from a development device (not shown) into the fixing assembly 150. The fixing assembly 150 includes oppositely positioned auxiliary rollers 30, 40 spaced along a path of the sheet 5 fed from the feed plate 20, a main roller 10 held in rolling contact with the auxiliary rollers 30, 40, a cleaning roller 50 held against the peripheral surfaces of the auxliary rollers 30, 40 and rotatable thereby, a cleaning blade 40 held against the peripheral surface of the main roller 10, a sheet separator 70 for separating the sheet 5 from the main roller 10, and a sheet discharge plate 80. The temperature of the surface of the main roller 10 is detected by a temperature sensor 90.

At least one auxiliary roller is required in the fixing assembly 150, though the two auxiliary rollers 30, 40 are shown in FIG. 4. Each of the auxiliary rollers 30, 40 has a plurality of projections disposed on its peripheral surface and each having a surface area of at most $50 \times 50$ $\mu m^2$.

Figure 5:
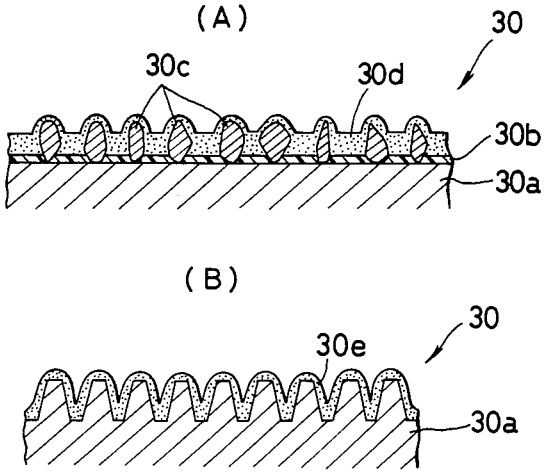
FIGS. 5(A) and 5(B) are enlarged fragmentary cross-sectional views of auxiliary rollers.

More specifically, as shown in FIG. 5(A), the projections are formed on the roller surface by scattering alumina particles 30*c* over an adhesive layer 30*b* coated on a roller body 30*a*, bringing the alumina particles 30*c* into contact with the roller body 30*a*, and coating a binder 30*d* on the surfaces of the alumina particles 30*c* for preventing the alumina particles 30*c* from being detached.

The projections may also be formed, as shown in FIG. 5(B), by knurling the surface of the roller body 30*a* and coating the knurled surface with a flame-sprayed layer 30*e* of stainless steel, silicon carbide or the like.

The auxiliary rollers 30, 40 are positioned in the direction of feed of the sheet 5 such that they can hold the sheet 5 against the peripheral surface of the main roller 10 in surrounding relation thereto. The auxiliary rollers 30, 40 have shafts resiliently biased by springs (not shown) for keeping the sheet 5 in intimate contact with the peripheral surface of the main roller 10.

The main roller 10 comprises a hollow roller of aluminum which is a good heat conductor. The main roller 10 has an outer peripheral surface which is made smooth to provide a larger area of contact with the sheet 5 than that of the rollers 30, 40. A heating means such as a halogen lamp 10A is disposed in the main roller 10. The main roller 10 is rotatable with the auxiliary rollers 30, 40. One or all of the main and auxiliary rollers 10, 30, 40 may be rotated by a drive means.

The temperature of the halogen lamp 10A in the main roller 10 is controlled by the temperature sensor 90 to keep the surface temperature of the main roller 10 at about 200° C.

When the sheet 5 is introduced into the fixing assembly 150, the sheet 5 is caused by the auxiliary rollers 30, 40 to contact the peripheral surface of the main roller 10. While being gripped by the rollers 10, 30, 40, the sheet 5 is fed over the discharge plate 80 toward the sheet outlet by simultaneous rotation of the rollers 10, 30, 40.

Since the main roller 10 has a smooth outer peripheral surface providing a larger area of contact with the sheet 5 than that of the auxiliary rollers 30, 40 and accommodates the halogen lamp 10A, the sheet 5 can be held in highly intimate contact with the main roller 10 by the auxiliary rollers 30, 40, and can be heated with increased heat transfer efficiency through the wide heating area. Inasmuch as the auxiliary rollers 30, 40 and the main roller 10 are in simultaneous rotation, toner particles of a toner image which has been fixed in a double-faced copying cycle to the surface of the sheet 5 held against the main roller 10 will not be rubbed by the main roller 10. Therefore, the quality of the toner image is prevented from being lowered.

Transfer of toner particles of an unfixed toner image on the opposite surface of the sheet 5 toward the auxiliary rollers 30, 40 is held to a minimum because of the roughened condition of the peripheral surfaces of the auxiliary rollers 30, 40. The area of the sheet 5 which is held against and heated by the main roller 10 is increased by the use of the two spaced auxiliary rollers 30, 40. Therefore, the pressure at which the auxiliary rollers 30, 40 are held against the main roller 10 is not required to be of a considerable degree, with the consequences that the main roller 10 may be of a reduced wall thickness and of a low thermal capacity, thereby allowing the main roller 10 to have a quick temperature rise.

Figure 6:
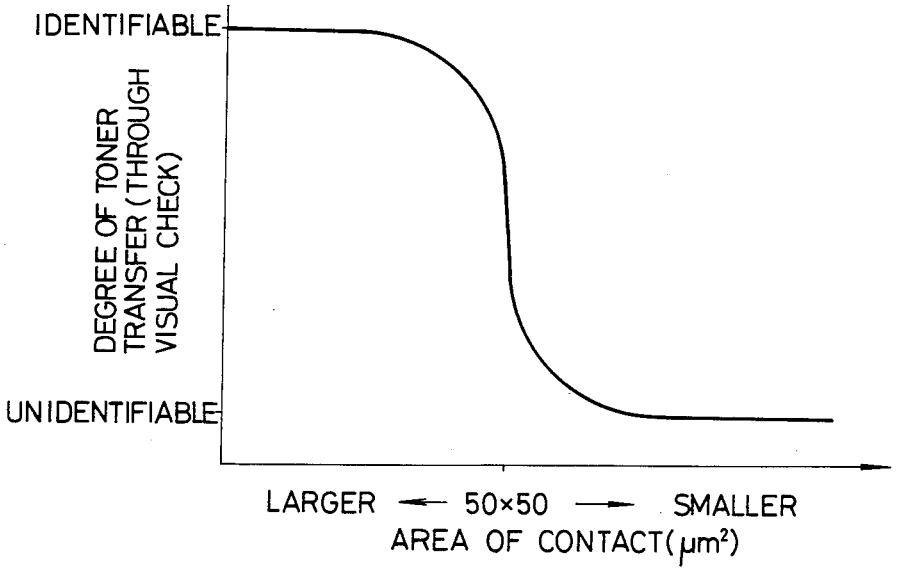
FIG. 6 is a graph illustrating the manner in which the degree of toner transfer onto an auxiliary roller varies dependent on the surface condition of the auxiliary roller.

The inventor conducted an experiment on the degree of toner transfer onto the auxiliary roller, and the results of the experiment are shown in FIG. 6.

The graph of FIG. 6 has a vertical axis representing the degree of toner transfer confirmed through visual check, which is more identifiable away from the origin of the graph. The horizontal axis of the graph indicates the area of contact of one projection on the auxiliary roller with the sheet, the area of contact being progressively smaller from the origin toward the right. Study of FIG. 6 clearly shows that the degree of toner transfer sharply varies across the area of contact of $50\times50\ \mu m^2$, below which substantially no toner transfer takes place.

Figure 7:
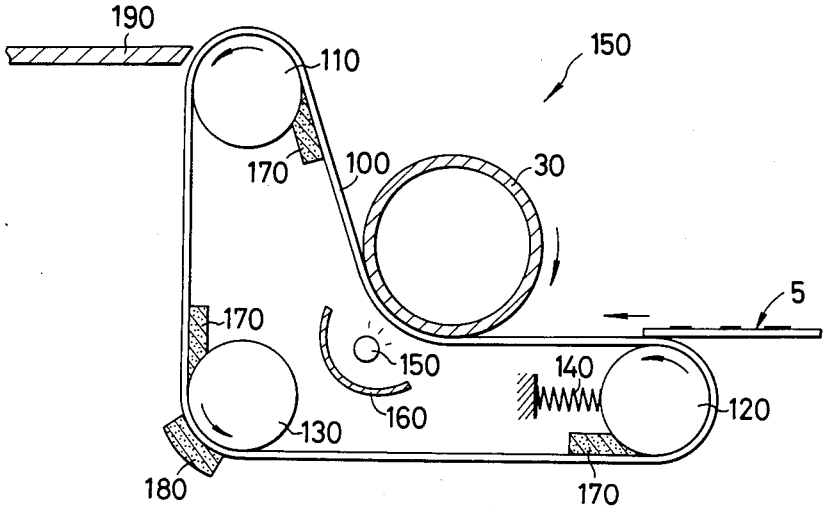
FIGS. 7 and 8 are sectional front elevational views of fixing devices according to other embodiments, wherein a main rotatable body comprises an endless belt.
Figure 8:
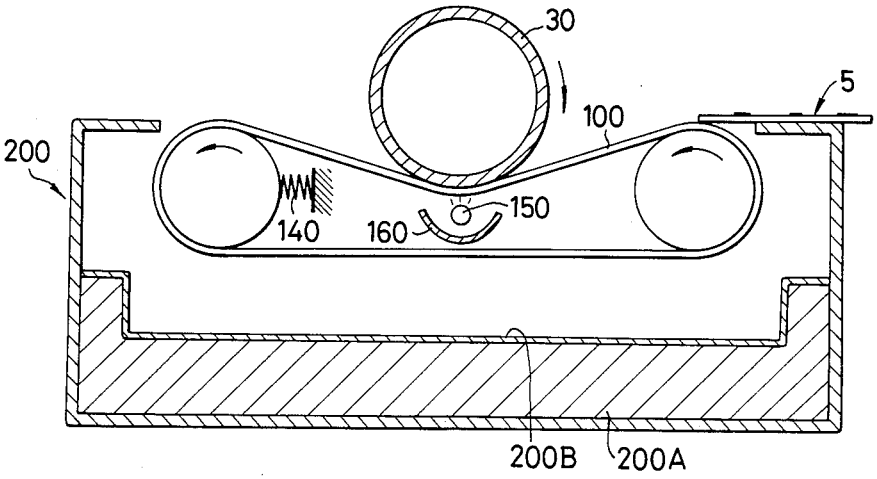

FIGS. 7 and 8 illustrate fixing devices according to different embodiments.

In FIG. 7, a fixing assembly 150 includes a main rotatable body which comprises an endless sheet feed belt 100 having at least a surface for contact with a sheet 5, made of a good heat conductor such as a belt electroformed of nickel or a stainless steel belt. The sheet feed belt 100 is held against an auxiliary roller 30 in surrounding relation to a portion of the peripheral surface of the auxiliary roller 30. The sheet feed belt 100 is trained around pulleys 110, 120, 130 and caused by contact with the auxiliary roller 30 to travel in the direction of feed of the sheet 5. Each of the pulleys 110, 120, 130 is of a thermally insulating material. The pulley 120 is biased by a spring 140 to serve as a tension pulley for tensioning the sheet feed belt 100.

The sheet feed belt 100 surrounds a space in which there is disposed a heat source comprising a halogen lamp 150 and a reflector 160 that are positioned behind the portion of the sheet feed belt 100 which is held against the auxiliary roller 30. Cleaning pads 170 are wedged between the sheet feed belt 100 and the respective pulleys 110, 120, 130 at their upstream positions for removing foreign matter attached to the back of the belt 100 to thereby prevent foreign objects from being pinched between the belt 100 and the pulleys 110, 120, 130. Another cleaning pad 180 of felt is held against the face of the portion of the belt 100 trained around the pulley 130 for cleaning the face of the belt 100. The sheet 5 discharged from the fixing assembly 150 is guided by a discharge plate 190.

In operation, the sheet feed belt 100 is heated by the halogen lamp 150. When the sheet 5 introduced into the fixing assembly 150 is placed on the sheet feed belt 100, the sheet 5 is heated by the belt 100. As the sheet 5 then comes into contact with the auxiliary roller 30, the sheet 5 is heated by the belt 100 while it is kept by the auxiliary roller 30 in intimate contact with the sheet feed belt 100.

Before the sheet 5 reaches the position where the belt 100 contacts the auxiliary roller 30, the sheet 5 is held in contact with the belt 100 as heated and preheated thereby. Consequently, the time period in which the sheet 5 is heated is increased for higher fixing efficiency. Since the auxiliary roller 30 and the belt 100 move in unison where they contact each other, any fixed toner image on the sheet 5 will not be rubbed even if toner images are fixed to both surfaces of the sheet 5. Where the sheet feed belt 100 is of small thermal capacity, the time required for reaching a desired temperature rise can be shortened.

To reduce heat loss from the sheet feed belt 100, only the portion of the belt 100 which carries the sheet 5 may be exposed while the remainder of the belt 100 may be housed in a thermally insulating casing 200. The thermally insulating casing 200 has a thermally insulating layer 200A and a reflecting mirror layer 200B placed on the upper surface of the layer 200A in facing relation to the belt 100. Thermal energy radiated downwardly from the belt 100 through its lower run is reflected back by the reflecting layer 200B, thus enabling the belt 100 to have an increased amount of stored heat.

Figure 9:
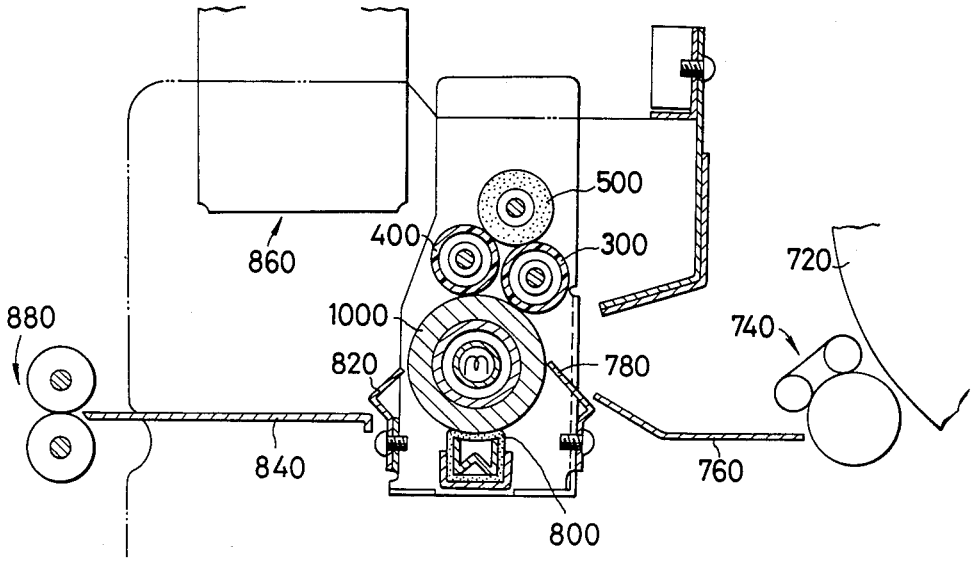
FIG. 9 is a sectional front elevational view showing another fixing device of the invention in greater detail.

FIG. 9 illustrates another fixing device in more detail. A copying machine incorporating the fixing device includes a photosensitive drum 720, sheet separator rollers 760, and a guide plate 760. The fixing device has an inlet guide plate 780, a main roller 1000, two auxiliary rollers 300, 400, a cleaning roller 500, a cleaning pad 800, an outlet guide plate 820, a discharge guide plate 840, a dring fan 860, and discharge rollers 880. The main roller 1000 and the auxiliary rollers 300, 400 consitute main components of a fixing assembly, and are disposed in opposite relation and rotatably supported on wall plates of the fixing assembly.

The main roller 1000 is positioned for contact with the back of a sheet opposite to its toner image carrying surface as the sheet is fed from the photosensitive drum 720. The main roller 1000 has a heating lamp housed therein for applying heat to the toner image from the sheet back to fuse the toner of the toner image. The auxiliary rollers 300, 400 are spaced apart from each other to keep the sheet held against the main roller 1000 in a wide area. The auxiliary rollers 300, 400 are also spaced from the main roller 1000 a distance sufficient to grip and feed the sheet between these rollers 300, 400 and 1000.

Figure 10:
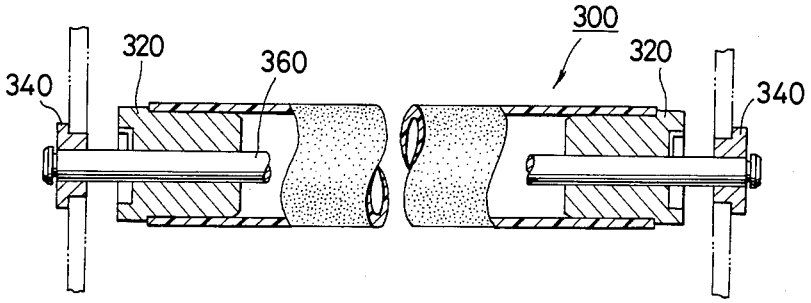
FIG. 10 is an enlarged fragmentary cross-sectional view of an auxiliary roller in the fixing device shown in FIG. 9.

As shown in FIG. 10, each of the auxiliary rollers 300, 400 comprises a hollow roller or sleeve having support members 320 fitted in the respective axial ends thereof and made of a thermally insulating material such as fluoroplastics, and a shaft 360 extending axially through the support members 320 and having opposite ends rotatably supported by respective bearings 340 on a copying machine frame.

Figure 11:
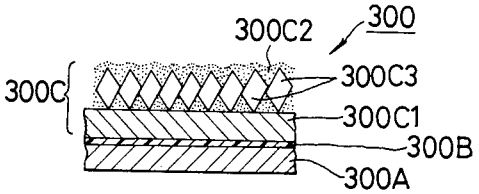
FIG. 11 is an enlarged fragmentary cross-sectional view of a peripheral portion of the auxiliary roller of FIG. 10.

As shown in FIG. 11, the hollow sleeve comprises a backing base layer 300A and an offset prevention surface layer 300C integrally bonded thereto by an adhesive layer 300B. The base layer 300A is in the form of a web of cotton cloth or a film of fluoroplastics. The offset prevention surface layer 300C comprises a base layer 300C1 and grinding particles 300C3 such as ceramic particles having sharp ends and bonded to the base layer 300C1 by a phenolic or epoxy binder 300C2.

The hollow sleeve is formed by spirally winding the base layer 300A in an axial direction, coating the adhesive layer 300B on the base layer 300A, and spirally winding the offset prevention surface layer 300C in the direction opposite to that in which the base layer 300A has been spirally wound.

By thus winding the base layer 300A and the offset prevention surface layer 300C in the opposite directions, these layers are directed in crossing relation to reduce the flexing of the layers between adjacent turns thereof for increased rigidity of the layers.

The thermal conductivity of the hollow sleeve can be appropriately changed by varying the materials of the layers such as the base layer.

The principles of the present invention are not limited to the fixing device in wet-type electrophotographic copying machines, but are applicable to various devices for feeding various sheets of paper or other webs for example. While one or two auxiliary rollers have been shown and described, more than two auxiliary rollers may be employed with adjacent ones thereof being positioned according to the present invention.

Although certain preferred embodiments have been shown and described, it should be understood that many changes and modifications may be made therein without departing from the scope of the appended claims.

What is claimed is:

1. A fixing device for use in a wet-type copying machine, comprising:

a main rotatable body;

means for heating said main rotatable body; and means for holding a sheet, which has a front side and a back side and carries on its front side a wet-type unfixed toner image, against said main rotatable body as heated by said heating means over a predetermined interval on the main rotatable body to allow the toner image to be fixed to the sheet and also to allow the sheet to be fed by said main rotatable body;

wherein:

the back side of said sheet makes contact with the main rotatable body while the front side, which carries said wet-type unfixed toner image, faces away from the main rotatable body and makes contact with said means for holding;

the surface of the main rotatable body which makes contact with the back side of the sheet is smooth; and the surface of the means for holding which makes contact with the front side of the sheet has a multiplicity of fine projections;

said holding means comprises an auxiliary roller adjacent to said main rotatable body for concurrent rotation therewith so that portions of said auxiliary roller and said main rotatable body will move in one direction, said main rotatable body and said auxiliary roller being capable of feeding a sheet held therebetween;

said main rotatable body comprises a main roller heated by said heating means; and said auxiliary roller comprises at least two auxiliary rollers spaced from each other, said main roller and adjacent ones of said auxiliary rollers being relatively positioned such that an angle formed between a first line tangential to both said main roller and an upstream one of said adjacent auxiliary rollers in the direction of feed of the sheet and a second line tangential to the downstream auxiliary roller at point where said first line intersects the peripheral surface of said downstream auxiliary roller is an obtuse angle.

2. A fixing device according to claim 1, further including a sheet separator disposed downstream of said auxiliary roller in the direction in which said main roller rotates, said sheet separator being held against the peripheral surface of said main roller.

3. A fixing device according to claim 1, wherein said auxiliary roller comprises two auxiliary rollers, the downstream auxiliary roller being larger in diameter than the upstream auxiliary roller.

4. A fixing device according to claim 1, further including a fan for applying hot air against the sheet having passed between said main roller and said auxiliary rollers.

5. A fixing device according to claim 4, further including an air deflector disposed below said fan for changing the direction of hot air applied by said fan.

6. A fixing device as in claim 1 in which said fine projections on the surface of the means for holding have areas of at most 50×50 microns.

* * * * *